United States Patent [19]

Meyer et al.

[11] Patent Number: 4,474,619

[45] Date of Patent: Oct. 2, 1984

[54] CONDITIONER FOR FLOTATION OF COAL

[75] Inventors: Wilfred C. Meyer; Robert D. Hansen, both of Midland, Mich.; Robert E. Hefner, Jr., Lake Jackson, Tex.

[73] Assignee: The Dow Chemical Company, Midland, Mich.

[21] Appl. No.: 311,380

[22] Filed: Oct. 14, 1981

Related U.S. Application Data

[63] Continuation of Ser. No. 109,724, Jan. 4, 1980, abandoned, which is a continuation-in-part of Ser. No. 006,942, Jan. 25, 1979, abandoned.

[51] Int. Cl.[3] ..... B03D 1/14

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 1,761,546 | 6/1930 | Trotter | 209/166 |
| 2,028,742 | 1/1936 | Frantz | 209/166 |
| 2,074,699 | 3/1937 | Lenher | 209/166 |
| 2,173,448 | 9/1939 | Katzman et al. | 209/166 |
| 2,173,909 | 9/1939 | Kritchevsky | 209/166 |
| 2,312,414 | 3/1943 | Jayne | 209/166 |
| 2,389,763 | 11/1945 | Cahn | 209/166 |
| 2,740,522 | 4/1956 | Aimone | 209/166 |

OTHER PUBLICATIONS

Organic Chemistry, 2nd Ed., Morrison and Boyd, Publishers Allyn and Bacon, Inc., pp. 666, 671 and 673, (Exhibit A).

*Primary Examiner*—Bernard Nozick

*Attorney, Agent, or Firm*—Michael L. Glenn

[57] ABSTRACT

The froth flotation of coal in the presence of a condensate of an alkanolamine with at least about 0.8 equivalent of a fatty acid improves the separation of carbonaceous solids possessing relatively high heat value from ash and other inert mineral matter. Flotation in the presence of this condensate is particularly effective to enhance the recovery of oxidized bituminous coal.

17 Claims, No Drawings

CONDITIONER FOR FLOTATION OF COAL

CROSS REFERENCE TO RELATED APPLICATION

This is a continuation of application Ser. No. 109,724 filed on Jan. 4, 1980, now abandoned, which is a continuation-in-part of application Ser. No. 006,942 filed on Jan. 25, 1979, now abandoned.

BACKGROUND OF THE INVENTION

This invention relates to the froth flotation of coal-containing ashes, coal sludge or coal-containing residues to recover coal containing a lower percentage of impurities. In particular, this invention relates to the use of a condensation product of an alkanolamine and a fatty acid as a conditioner for the flotation of finely-divided coal.

The natural process of "coalification" inherently deposits some non-combustible mineral matter in association with the combustible carbonaceous solids. Large fragments of non-combustible material can be removed by screening or other gravity concentration techniques, but other cleaning methods more efficiently remove fine material intimately associated with the carbonaceous solids. Froth flotation of coal is used in the art to beneficiate finely-divided raw coal. Bituminous coals generally possess a natural hydrophobicity, which results in the coal being floatable in the presence of a frother, such as methyl isobutyl carbinol, desirably with a relatively mild collector, such as kerosene. However, anthracite coals, as well as coals of all ranks in which the surface has been at least partially oxidized, float poorly in such a medium, resulting in the loss of significant amounts of combustible material in the tail from the flotation.

The loading of the oil-type collector is generally 0.05 to 1 kilogram per metric ton of coal feed for bituminous coals of intermediate or low rank, with the loading being relatively greater for the flotation of lignite and anthracite coals. However, good recovery of oxidized coals or lignite coals can only be effected at such high loadings of the oil-type collector that significant amounts of inert material are floated along with the combustible materials. Sun suggests in *Trans. AIME,* 199:396–401 (1954), that fatty amines can be utilized as co-collectors in the flotation of oxidized coals to effect enhanced recovery. However, even these amine collectors float substantial amounts of ash along with the coal and effect only partial recovery of combustible material.

SUMMARY OF THE INVENTION

According to this invention, coal is beneficiated in a froth flotation process comprising the steps of:

(a) classifying the coal to separate particles of flotation size; and (b) floating the sized coal in a frothing aqueous medium comprising a fuel oil collector and an effective amount of a condensation product, or an acid-neutralized derivative of the condensation product, of an alkanolamine corresponding to the formula

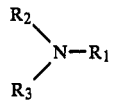

I wherein $R_1$ is a $\beta$-hydroxyalkyl group or inertly substituted $\beta$-hydroxyalkyl group having 2 to 5 carbon atoms; and $R_2$ and $R_3$ are independently $R_1$, hydrogen, an alkyl group of from 1 to 4 carbon atoms or a monovalent group corresponding to the formula

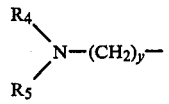

II wherein y is an integer of 2 to 3; and $R_4$ and $R_5$ are independently $R_1$, hydrogen, or an alkyl of from 1 to 4 carbon atoms;

condensed with a fatty acid or fatty acid ester in a molar ratio of at least about 0.8 mole fatty acid or fatty ester per mole of the alkanolamine.

DETAILED DESCRIPTION OF THE INVENTION

The alkanolamine utilized as a component of the condensation product in the practice of this invention is an unsubstituted or N-alkyl substituted monoethanolamine; diethanolamine; triethanolamine; hydroxyethylethylenediamine; N,N'-di(hydroxyethyl)ethylenediamine; N,N-di(hydroxyethyl)ethylenediamine; N,N,N'-tri(hydroxyethyl)ethylenediamine; N,N,N',N'-tetra(hydroxyethyl)ethylenediamine; and like compounds in which the ethylene moiety is replaced by a propylene group and/or the hydroxyethyl group is replaced by a $\beta$-hydroxyalkyl group having from 3 to 5 carbon atoms. For reasons of economics the hydroxyalkyl group is desirably a hydroxyethyl, 1-methyl(hydroxyethyl) or 1-ethyl(hydroxyethyl) group. However, the above-identified unsubstituted alkanolamines bearing only hydroxyethyl and ethylene moieties are preferred. Diethanolamine, triethanolamine and di-, tri- or tetra(hydroxyethyl)ethylenediamine are especially preferred alkanolamines, with diethanolamine being the most preferred. The alkanolamine can be a single compound or a mixture of operable alkanolamines, with the latter being preferred for economic reasons. These alkanolamines are available commercially or can be readily prepared by the reactions of alkylene oxides with ammonia or an alkylene diamine in a manner known to the art.

The fatty acid condensed with the alkanolamine can operably be a fatty acid having a saturated or unsaturated alkyl group. The fatty acid can suitably bear hydroxyl substituents on its alkyl portion, but such substitution does not impart any substantial advantage. Fatty acids such as oleic, lauric, linoleic, palmitic, stearic, myristic, mixtures thereof and other like fatty acids are operable. The esters corresponding to the fatty acids, such as glycerides, are also operable, but less preferred. For reasons of economy, it is preferred to use crude mixtures of fatty acids with minor amounts of rosin acids, lignin and unsaponifiable material, such as tall oil, coconut oil, palm oil, palm kernel oil, cottonseed oil, linseed oil, olive oil, peanut oil, fish oil and the like. Tall oil and tall oil heads are especially preferred mixtures of fatty acids. Tall oil and tall oil heads are well-known compositions described in the *Kirk-Othmer, Encyclopedia of Chemical Technology, 2nd Ed.,* Vol. 19, pp. 614–629 (1969), which is incorporated herein by reference.

The fatty acid or corresponding ester and the alkanolamine can be readily reacted by bringing these reactants together and heating until the desired degree of condensation has taken place as indicated by the water distilled overhead or infrared spectrophotometric analysis of the condensation product. Generally, a reaction temperature of from about 120° C. to about 250° C. is operable. The reaction is termed a condensation herein to distinguish it from the formation of the ammonium salt of the acid at lower temperatures. Dependent on the alkanolamine, the condensation product may be an ester, an amide or both. Although it is desirable that the condensation reaction is substantially complete to make most efficient use of the reactants, the condensation product is operable, but less effective, as a conditioner for coal in the presence of a substantial amount of unreacted fatty acid and the uncondensed alkanolammonium salt of the acid. The term "conditioner" indicates that the condensation product is primarily effective to enhance the hydrophobicity of the coal surface. However, the use of the descriptive term "conditioner" is not intended to exclude the possibility that this condensation product acts as a co-collector with the fuel oil.

The efficacy of the instant condensation product is greatest when the reactants are condensed in a specific range of mole ratios. At least a stoichiometric amount of the fatty acid or its equivalent (i.e., fatty ester) is desirably condensed with the alkanolamine, although a less than equimolar amount is operable. The molar ratio of fatty acid or fatty ester to the alkanolamine is preferably from about 1.5:1 to about 5:1, more preferably about 2:1 to about 3:1. However, to avoid waste of fatty acid, the number of moles of fatty acid and ester in the condensate should not exceed the number of moles of alkanolamine multiplied by the average number of reactive sites on a molecule of the alkanolamine. The term "reactive sites" refers to the exchangeable hydrogen substituents on the amine group and the reactive hydroxyl substituents on the hydroxyalkyl group, which will react with the fatty acid or fatty acid ester to produce amides and esters respectively.

Acid derivatives of the above-described condensation products are operable, as well as the condensates themselves, in the instant flotation process. These derivatives are prepared by adding an inorganic or organic acid to the condensate so as to reduce the pH of the resulting mixture. The derivative may be a either salt, partial salt or an acid complex. The organic acid derivatives are generally more readily dispersed in the aqueous flotation medium than are the parent compounds. These derivatives may exhibit greater activity or less activity than their parent compounds, but this relationship is not fully understood. Common inorganic acids which can be used to prepare the acid derivatives include phosphoric, nitric, boric, hydrochloric, hydrobromic and sulfuric acids. These inorganic acid derivatives are operable, but not preferred. Organic acids which can be used include aliphatic mono-, di-, or tricarboxylic acids; lower alkyl carboxylic acids; mono- or dihydroxy lower alkyl carboxylic acids; amino-substituted carboxylic acids and unsaturated aliphatic carboxylic acids. Representative examples of these organic acids are formic, acetic, hydroxyacetic, propionic, butyric, isovaleric, lactic, gluconic, aminoacetic, malonic, succinic, adipic, malic, tartaric, glutaric, fumaric, citric, salicylic, benzoic and naphthenic acids and the like. Fatty acids are operable, but not preferred. Acetic acid, and other lower alkyl organic carboxylic acids, especially the $C_1$ to $C_4$ organic acids, are preferred for this purpose. In one especially preferred embodiment, 0.5 mole of acetic or propionic acid is added per mole of a condensate prepared from 1 equivalent of diethanolamine condensed with two equivalents of tall oil fatty acid. Titration with a base, as well as infrared and proton magnetic resonance spectroscopy of the resulting acetic or propionic acid derivative of this condensate indicate that an acid complex is formed and not a salt.

The loading of condensation product in the flotation medium which effects the greatest recovery of combustible carbonaceous matter with a tolerable amount of inert matter is affected by the size, rank, degree of oxidation and inert matter content of the coal feed, as well as the loading of frother and other adjuvants. The term effective amount of a condensation product is used herein to denote the amount of said product required to increase the recovery of coal by froth flotation in the presence of fuel oil and a frother. Generally, where the condensation product is employed with only fuel oil, the condensate is advantageously employed in a ratio of from about 0.001 to about 1.0, preferably about 0.002 to about 0.2 kilograms of condensate per (metric) ton of coal flotation feed.

The instant condensation product can be utilized in conjunction with co-collectors or other adjuvants, such as activators, conditioning reagents, dispersing reagents, frothing reagents and depressing reagents. Fuel oil is employed in the flotation medium as a collector. Representative fuel oils include diesel oil, kerosene, Bunker C fuel oil, mixtures thereof and the like. The fuel oil can generally be advantageously employed in a ratio of from about 0.02 to about 2.5 kilograms fuel oil per (metric) ton of coal flotation feed. The optimal loading of fuel oil in the flotation medium is influenced by numerous factors, such as the size, degree of oxidation and rank of the coal to be floated and the loading of condensate and frother. Therefore, the loading of the fuel oil should be optimized empirically to effect the greatest selectivity and recovery during flotation. In one preferred embodiment the conditioner is charged to the flotation medium dispersed in part or all of the fuel oil charge.

A frothing agent should be present in the flotation medium to promote formation of a froth. Conventional frothers, such as pine oil, cresol, $C_4$ to $C_8$ alkanols containing one or two tertiaryl or one quaternary carbon atom, e.g., isomers of amyl alcohol, are suitable for this purpose. However, methyl isobutyl carbinol and polypropylene glycol alkyl or phenyl ethers are preferred as frothers, with polypropylene glycol methyl ethers having a weight average molecular weight between about 200 and about 600 being most preferred. The optimal loading of frother in the flotation medium is influenced by a number of factors, most important of which is the rank and degree of oxidation of the coal. Generally, a ratio of from about 0.05 to about 0.5 kilogram frother per ton of coal feed is advantageous.

The coal to be floated by the instant process can suitably be anthracite, bituminous, subbituminous or the like. This process is preferably employed to float coal which cannot be floated with conventional frothers alone and is particularly effective in the flotation of bituminous coal of intermediate or low rank, where the surface of the coal is oxidized to an extent which significantly impedes the flotation of the coal using conventional agents.

The size of the coal particles to be separated by flotation is important as generally particles larger than about 28 mesh (U.S. Sieve Size) are difficult to float. In typical operations, coal particles larger than 28 mesh, advantageously larger than 100 mesh, are separated from both the inert material mined therewith and more finely divided coal by gravimetric separation techniques. However, if a substantial fraction of the coal in the flotation feed comprises particles larger than 28 mesh, it is desirable that the feed be comminuted further prior to flotation.

The sized coal flotation feed optionally is first washed and then mixed with sufficient water to prepare an aqueous slurry having a solids concentrate which promotes rapid flotation. Generally, a solids concentration between about 2 to about 20 weight percent solids, more preferably from about 5 to about 10 weight percent, is preferred. The aqueous coal slurry is advantageously conditioned with the condensation product, a frother, fuel oil and any other adjuvants by mixing with the slurry in a manner known to the art. Generally for difficult to float coal, it is advantageous to contact with mixing the coal slurry with the conditioner and fuel oil for a period of time prior to flotation, so as to effect intimate contact of the conditioner and fuel oil with substantially all of the coal. Where the aqueous coal slurry is prepared in a container distinct from the flotation cell and then is conveyed to the flotation through conduits, the desired intimate contact can conveniently be attained by introducing the conditioner and fuel oil to the slurry upstream from the flotation cell. The frother, however, should be introduced to the slurry shortly before or during flotation to provide maximum frothing.

The coal is operably floated at the natural pH of the coal in the aqueous slurry, which can vary from about 3.0 to about 9.5 depending upon the composition of the feed. However, a pH adjusting composition is optionally used as necessary to adjust and maintain the pH of the aqueous coal slurry prior to and during flotation to a value from about 4 to about 9, preferably about 4 to about 8, which generally promotes the greatest coal recovery. If the coal is acidic in character, the pH adjusting composition can operably be an alkaline material, such as soda ash, lime, ammonia, potassium hydroxide or magnesium hydroxide, with sodium hydroxide being preferred. If the aqueous coal slurry is alkaline in character, a carboxylic acid, such as acetic acid and the like, or a mineral acid, such as sulfuric acid, hydrochloric acid and the like, are operable to adjust the pH.

The conditioned and pH-adjusted aqueous coal slurry is aerated in a conventional flotation machine or bank of rougher cells to float the coal. Any suitable rougher flotation unit can be employed.

The practice of the process of the instant invention can be used alone to beneficiate coal. Alternatively, the process can be used in conjunction with secondary flotations following the instant process to effect even greater beneficiation of the coal.

The following examples are illustrative embodiments of this invention. Unless otherwise indicated, all parts and percentages are by weight.

EXAMPLE 1

In a series of substantially identical flotation runs that differ principally in the identity of the frother and presence or absence of an alkanolamine/fatty acid condensation product, a 200 gram charge of comminuted coal is diluted with deionized water to a slurry of 6.67 percent solids. The coal is a low grade, bituminous coal having a highly oxidized surface as indicated by the high oxygen content (14.3 percent) of the coal as determined by elemental analysis techniques. The fraction of the coal feed consisting of particles larger than 25 mesh is separated before dilution, comminuted and then recombined with the remainder of the coal. The comminuted coal feed is more than 90 percent particles smaller than 80 mesh. The coal as charged to the slurry contains about 14.7 percent ash.

This aqueous coal slurry is introduced into a flotation machine (specifically, a Galigher Agitair Flotation Machine) having a three-liter cell. The pH of the slurry is determined to be about 4. The coal slurry is agitated for about seven minutes to thoroughly wet the coal, at which time a refined kerosene (sold under the tradename Soltrol ®100 by Phillips Petroleum Co.) is added to the slurry to effect a loading of about 2.5 kilograms of kerosene per ton of coal feed. In two flotation runs embodying the instant process, a condensate prepared from a molar ratio of 1 part diethanolamine (DEA) to 2 parts tall oil fatty acid (TOFA) is introduced with the kerosene into the aqueous coal slurry in a loading of about 0.125 kilogram of condensate per ton of coal feed. The tall oil fatty acid reactant is one sold by Emery Industries, Inc. under the tradename Emtall ®729. This tall oil fatty acid according to analysis by conventional methods contains 39 percent rosin acids, 29.3 percent oleic acid, 23 percent linoleic acid, 3.7 percent conjugated linoleic acid, 1.8 percent stearic acid and about 5 percent other acids and components. Two control flotation runs not embodying the present invention are also made in which kerosene is the collector added to the slurry.

After the kerosene is added to the slurry, the slurry is agitated for one minute to condition the coal. A frothing agent is then added to the slurry to effect a loading of 0.2 kilograms frother per ton of coal feed. Methyl isobutyl carbinol (MIBC) and a polypropylene glycol methyl ether having a weight average molecular weight of about 400, sold under the tradename DOWFROTH 1012 (D-1012), are each employed as frothers in separate runs. The aqueous coal slurry is conditioned by agitation for one minute, after which aeration of the medium is initiated and continued for four minutes. A frothy concentrate is collected during aeration.

The collected concentrate is first dried in an oven and then weighed. The percent recovery of coal by flotation is determined from the weight of coal in the concentrate divided by the weight of coal (i.e., total weight less weight of ash) in the 200 gram charge. A one-gram sample of the concentrate is completely burned and the ash content of the concentrate is determined from the weight of the material remaining after combustion. Table I tabulates the identity of the conditioner and frothing agent for each run as well as the percent recovery of coal and ash content in the concentrate. The results of a comparative flotation, in which a prior art fatty amine co-collector, dodecylamine hydrochloride (DDA·HCl), is used in place of the DEA/TOFA condensate in a flotation otherwise identical to that set out above, is also included in Table I.

TABLE I

| Run | Conditioner | Frother | Coal Recovery | Ash Content |
|---|---|---|---|---|
| A | DEA/TOFA | D-1012 | 72% | 9.0% |
| B* | None | " | 36% | 9.1% |
| C | DEA/TOFA | MIBC | 53% | 10.3% |
| D* | None | " | 13% | 7.5% |
| E* | DDA.HCl | D-1012 | 53% | 11.8% |

*Not an embodiment of this invention.

The data in Table I demonstrate that the presence of condensation products of DEA with TOFA in the flotation medium greatly enhances the recovery of oxidized coal relative to flotation systems utilizing only kerosene. Further, the DEA/TOFA conditioner in Run A exhibits both enhanced coal recovery and less ash co-flotation than the prior art fatty amine utilized in Run E.

EXAMPLE 2

A series of substantially identical flotation runs are performed in the same manner as Example 1, with the exception of minor differences disclosed hereinafter. After the pH of the aqueous coal slurry is measured, it is adjusted in two separate runs to pH values of 7 and 9, respectively, by the addition of sodium hydroxide. The pH of the coal slurry in a third run is measured, but not adjusted. The coal in each of the three slurries is then floated in the presence of DEA/TOFA, Soltrol ®100 kerosene and DOWFROTH 1012 frother in the manner and at the loadings set out in Example 1. The results and identifying parameters for each run are tabulated in Table II.

TABLE II

| Run | Slurry pH | Coal Recovery |
|---|---|---|
| A | 4.0 | 72% |
| B | 7.0 | 67% |
| C | 9.0 | 47% |

The data in Table II demonstrate the effect of slurry pH on the recovery of clean coal by flotation of this particular oxidized bituminous coal.

EXAMPLE 3

Seven flotation runs are performed in the same manner as Example 1, with the exception of minor differences disclosed hereinafter. The flotation runs are substantially identical with the exception of the condensation product employed as a conditioner. The condensation product is prepared in each case by condensing the tall oil fatty acid identified in Example 1 with an alkanolamine selected from diethanolamine (DEA), triethanolamine (TEA) and a mixture of hydroxyethyl-substituted ethylene diamines (HEEDA). The HEEDA mixture consists of about 10 percent aminoethylethanolamine, about 75 percent di(hydroxyethyl)ethylenediamine, about 12 percent tri(hydroxyethyl)ethylenediamine and about 3 percent tetra(hydroxyethyl)ethylenediamine. The alkanolamine (AA) and tall oil fatty acid (TOFA) are condensed in the molar ratio tabulated hereinafter. The coal in each of the three slurries is floated with 0.125 kilograms of the condensation product per ton of coal feed along with Soltrol ®100 kerosene and DOWFROTH 1012 frother in the manner and at the loadings set out in Example 1. The results and identifying parameters for each run are tabulated in Table III.

TABLE III

| Run | Conditioner | Ratio AA:TOFA | % Coal Recovery | % Ash Content |
|---|---|---|---|---|
| A | DEA/TOFA | 1:2.5 | 62 | 8.3 |
| B | " | 1:2 | 63 | 8.2 |
| C | " | 1:1 | 56 | 9.2 |
| D | TEA/TOFA | 1:3 | 60 | 8.8 |
| E | HEEDA/TOFA | 1:4 | 66 | 8.7 |
| F | " | 1:3 | 64 | 8.9 |
| G | " | 1:2 | 57 | 10.0 |

EXAMPLE 4

Fourteen flotation runs are performed in the general manner of Example 1, with the exception of differences disclosed hereafter. Seven different raw coals, having the ash contents tabulated hereinafter, are each floated in a pair of runs in which a 1:2 condensate of DEA/-TOFA is employed in only one of the pair, the other run acting as a control. The coal in each case is introduced as an aqueous slurry into a flotation machine (specifically, a Wemco Froth Cell). The pH of the slurry is measured and then DOWFROTH 1012 frother, Soltrol ®100 kerosene and the DEA/TOFA condensate are introduced into the slurry at the loadings of kilograms per ton of coal feed specified in Table IV. After flotation is complete the concentrate is recovered and the ash content and recovery of coal determined in the manner previously described.

TABLE IV

| Coal | pH | DEA/TOFA (kg/ton) | Kerosene (kg/ton) | FROTHER (kg/ton) | % Ash Feed | % Ash Conc. | % Coal Recov. |
|---|---|---|---|---|---|---|---|
| A | 8.4 | 0.018 | 0.35 | 0.1 | 28.3 | 9.4 | 90.2 |
| A* | " | none | 0.37 | " | " | 9.7 | 79.0 |
| B | 4.9 | 0.075 | 0.68 | 0.1 | 14.0 | 6.2 | 73.0 |
| B* | " | none | 0.75 | " | " | 6.3 | 59.7 |
| C | 8.2 | 0.09 | 1.75 | 0.2 | 30.2 | 14.9 | 85.0 |
| C* | " | none | 1.85 | " | " | 15.0 | 75.0 |
| D | 6.5 | 0.075 | 0.68 | 0.1 | 22.7 | 9.5 | 90.0 |
| D* | " | none | 0.75 | " | " | 7.9 | 80.4 |
| E | 8.8 | 0.037 | 0.34 | 0.1 | 38.8 | 10.7 | 83.3 |
| E* | " | none | 0.75 | " | " | 10.5 | 80.9 |
| F | 3.4 | 0.019 | 1.65 | 0.2 | 17.6 | 11.3 | 83.7 |
| F* | " | none | 1.85 | 0.15 | " | 11.9 | 60.6 |
| G | 9.0 | 0.075 | 0.68 | 0.1 | 22.4 | 7.7 | 83.3 |
| G* | " | none | 0.75 | 0.1 | " | 6.9 | 69.2 |

*Not an embodiment of this invention.

The data tabulated demonstrate that the condensation product of DEA with TOFA enhances the recovery of clean coal from each of the raw coals tested. Further, this enhancement is manifested despite the fact that a relatively smaller loading of kerosene is employed in the runs with the condensate than in the control runs.

EXAMPLE 5

In the general manner of Example 1, five flotation runs are performed using an 8 percent dispersion of a 1:2 condensate of DEA/TOFA or an acetic acid or propionic acid derivative thereof in #1 diesel oil as the conditioner collector. These acid derivatives consist of 0.5 mole of acetic or propionic acid for each mole of the condensate. These derivatives are believed to be hydrogen bonded acid complexes of the condensate, inasmuch as the acetic acid introduced is titratable stoichiometrically with 0.085 normal KOH. Infrared and proton magnetic resonance spectroscopic analysis also indicate that an acid complex with hydrogen bonding is present. In each run, 200 grams of coal containing 14.4 percent ash in 3 liters of water is introduced into a flotation machine and conditioned for 7 minutes. The pH of the slurry is adjusted to the values tabulated in Table V with a 1 normal aqueous solution of NaOH or HCl.

The slurry is agitated while #1 diesel oil containing the conditioner is charged to the slurry to effect a loading equivalent to about 1.5 kilograms of diesel oil per ton of coal feed and 0.12 kilograms of the condensate per ton of coal. A small amount (0.04 $cm^3$) of a conventional frother (D-1012) is added to the slurry and the slurry agitated for 10 seconds. The results and identifying parameters for each run are tabulated in Table V.

TABLE V

| Run | Conditioner | pH | % Coal Recovery | % Ash Content |
|---|---|---|---|---|
| A | DEA/TOFA | 5.1 | 88.0 | 9.8 |
| B | Acetic Acid Derivative of DEA/TOFA | 5.0 | 88.0 | 10.2 |
| C | Propionic Acid Derivative of DEA/TOFA | 5.0 | 87.9 | 9.7 |
| D | DEA/TOFA | 8.0 | 79.3 | 9.3 |
| E | Acetic Acid Derivative of DEA/TOFA | 8.0 | 80.7 | 9.3 |

EXAMPLE 6

A 1:2 condensate of DEA/TOFA and an acetic acid derivative thereof was tested in a commercial coal flotation facility. The acetic acid derivative consists of 0.5 mole of acetic acid for each mole of condensate. The conditioner was added to #1 diesel oil in a quantity sufficient to effect an increase of 10 percent in volume. The mixture of conditioner and #1 diesel oil was introduced at a rate of 200 cubic centimeters per minute to the tank used to collect the coal prior to introduction to the four banks of Daniel flotation cells. In one instance, diesel oil alone was introduced for purposes of comparison. The pH of the coal slurry in the collecting tank was determined for each run. The coal to be floated was smaller than 100 mesh. To each bank of cells at the air port of the first of the four cells in the bank was introduced 67 cubic centimeters per minute of a conventional frother (D-1012). A sample of the coal feed was recovered as it was introduced to the first cell in one of the banks of cells for each of the diesel oil compositions. Samples of the material recovered by froth flotation and the material in the tail were taken from near the end of the second cell in the bank of four cells.

The samples of coal feed, floated material and tail material in each instance were dried and then weighed. One-gram samples of the coal feed, the floated material (or concentrate) and the tail material are then each burned and the weight of the unburned ash determined. The difference in the weight of each of the fractions before and after combustion was assumed to be the weight of coal present in each fraction. The percentage of the ash-free or "clean" coal recovered can then be calculated by the formula:

$$\text{Percent Clean Coal} = 100 \times \frac{C(F-T)}{F(C-T)}$$

where:

C=100-(Percent Ash in Concentrate)

F=100-(Percent Ash in Feed Material)

T=100-(Percent Ash in Tail Material)

The results and identifying parameters are tabulated in Table VI.

TABLE VI

| Run | Conditioner | pH | % Ash in Feed | % Ash in Concentrate | % Clean Coal Recovered |
|---|---|---|---|---|---|
| A | Acetic Acid Derivative of DEA/TOFA | 6.9 | 47.8 | 13.8 | 38.0 |
| B | DEA/TOFA | 6.8 | 50.1 | 13.8 | 21.1 |
| C | None* | 6.7 | 42.7 | 11.5 | 10.6 |

*Not a composition of this invention.

The data compiled in Table VI indicates that the claimed acetic acid derivative of the DEA/TOFA condensate is much more effective in floating certain coals in a commercial flotation operation than diesel oil alone or diesel oil containing the DEA/TOFA condensate but not acetic acid.

What is claimed is:

1. A froth flotation process for beneficiating coal which comprises the steps of:

(a) classifying the coal to separate particles of flotation size; and (b) floating the sized coal in a frothing aqueous medium comprising a fuel oil collector and an effective amount of a condensation product, or an acid derivative of the condensation product, of an alkanolamine corresponding to the formula I

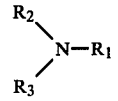

I wherein $R_1$ is a $\beta$-hydroxyalkyl group or inertly-substituted $\beta$-hydroxyalkyl group having 2 to 5 carbon atoms;

$R_2$ is $R_1$, hydrogen, or an alkyl group of from 1 to 4 carbon atoms; and $R_3$ is $R_1$, hydrogen, an alkyl group of from 1 to 4 carbon atoms or a monovalent group corresponding to the formula

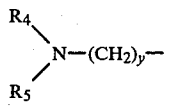

II wherein y is an integer 2 or 3;

$R_4$ and $R_5$ are independently $R_1$, hydrogen or an alkyl of from 1 to 4 carbon atoms;

condensed with a fatty acid or fatty acid ester in a molar ratio of at least about 0.8 mole fatty acid or fatty acid ester per mole of the alkanolamine.

2. The process as described in claim 1 wherein the coal to be beneficiated has an oxidized surface.

3. The process as described in claim 2 wherein the coal is a bituminous coal having an oxidized surface.

4. The process as described in claim 2 wherein the $\beta$-hydroxyalkyl group is $\beta$-hydroxyethyl.

5. The process as described in claim 4 wherein $R_2$ is hydrogen and $R_3$ is $\beta$-hydroxyethyl.

6. The process as described in claim 5 wherein the molar ratio of fatty acid and ester to alkanolamine is from about 1.5:1 to about 3:1.

7. The process as described in claim 4 wherein $R_2$ is selected from the group consisting of $\beta$-hydroxyethyl and hydrogen, and $R_3$ is a univalent group corresponding to the formula

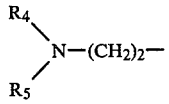

II wherein $R_4$ and $R_5$ are individually selected from the group consisting of $\beta$-hydroxyethyl and hydrogen, with the proviso that at least one of $R_2$ and $R_4$ is $\beta$-hydroxyethyl.

8. The process as described in claim 7 wherein the molar ratio of fatty acid and ester to alkanolamine is from about 1.5:1 to 4:1.

9. The process as described in claim 5 or 7 wherein the fatty acid or fatty acid ester is a tall oil fatty acid or a tall oil fatty ester.

10. The process as described in claim 5 wherein the coal is floated in the presence of a $C_1$–$C_4$ monocarboxylic acid derivative of the condensate.

11. The process as described in claim 10 wherein the coal is floated in the presence of an acetic or propionic acid complex the condensate in which 0.5 mole of acetic or propionic acid is present for each mole of condensate.

12. The process as described in claim 11 wherein the fatty acid or fatty acid ester is a tall oil fatty acid or a tall oil fatty acid ester.

13. The process as described in claim 12 wherein the molar ratio of tall oil fatty acid and ester to diethanolamine in the condensation product is from about 2:1 to about 3:1.

14. The process as described in claim 2 wherein the frothing aqueous medium further comprises an effective amount of a conventional frothing agent.

15. The process as described in claim 14 wherein the frothing agent is a monomethylether of a polypropylene glycol of about 200 to about 600 weight average molecular weight.

16. The process as described in claim 14 wherein the frothing agent is at least one branched $C_4$–$C_8$ alkanol.

17. The process as described in claim 16 wherein the frothing agent is methyl isobutyl carbinol.

* * * * *